US008046853B1

(12) United States Patent
Von Felden et al.

(10) Patent No.: US 8,046,853 B1
(45) Date of Patent: Nov. 1, 2011

(54) ADJUSTABLE-LENGTH SPINE-IMMOBILIZING BACKBOARD

(76) Inventors: Adam Von Felden, Minneapolis, MN (US); Thomas Flanagan, Minneapolis, MN (US)

( * ) Notice: Subject to any disclaimer, the term of this patent is extended or adjusted under 35 U.S.C. 154(b) by 0 days.

(21) Appl. No.: 12/372,581

(22) Filed: Feb. 17, 2009

(51) Int. Cl.
*A61G 1/013* (2006.01)

(52) U.S. Cl. ..... 5/627; 5/625; 5/626; 128/870

(58) Field of Classification Search ..... 5/625–628, 5/181, 185; 128/870
See application file for complete search history.

(56) References Cited

U.S. PATENT DOCUMENTS

| | | | | |
|---|---|---|---|---|
| 2,417,378 | A * | 3/1947 | Robinson | 5/627 |
| 3,125,766 | A * | 3/1964 | Halperin | 5/627 |
| 3,426,367 | A | 2/1969 | Bradford | |
| 3,449,776 | A * | 6/1969 | Brock | 5/627 |
| 3,574,871 | A | 4/1971 | Greene | |
| 3,601,824 | A | 8/1971 | Bradford | |
| 3,653,079 | A | 4/1972 | Bourgraf et al. | |
| 3,663,972 | A * | 5/1972 | Denton | 5/625 |
| 3,707,734 | A | 1/1973 | Matthews | |
| 3,801,208 | A | 4/1974 | Bourgraf et al. | |
| 3,886,606 | A | 6/1975 | Bradford | |
| 4,369,982 | A | 1/1983 | Hein et al. | |
| 4,383,526 | A | 5/1983 | Robins | |
| 4,579,381 | A * | 4/1986 | Williams | 296/20 |
| 4,627,428 | A | 12/1986 | Brooks | |
| 4,872,656 | A | 10/1989 | Brendgord et al. | |
| 4,928,711 | A | 5/1990 | Williams | |
| 5,016,620 | A * | 5/1991 | Matthews | 602/19 |
| 5,154,186 | A | 10/1992 | Laurin et al. | |
| 5,179,746 | A * | 1/1993 | Rogers | 5/625 |
| 6,295,672 | B1 | 10/2001 | Vassallo, Jr. | |
| 6,659,104 | B2 | 12/2003 | Kiefer et al. | |
| 6,772,461 | B2 | 8/2004 | Gaspar | |
| 6,842,923 | B1 | 1/2005 | Castellani et al. | |
| 6,883,195 | B1 | 4/2005 | Gustavsen | |
| 7,036,167 | B2 | 5/2006 | Tomcany et al. | |

(Continued)

FOREIGN PATENT DOCUMENTS

| | | |
|---|---|---|
| CA | 2143976 AA | 9/1996 |
| RU | 2310240 C2 | 11/2007 |

OTHER PUBLICATIONS http://www.centurionsafety.net/Safety/Centurion_Innovations/RSS(tm)_Rucksack_Stretcher_System.html The RSS™ looks like a day sack or emergency grab bag. But it is much more.

(Continued)

*Primary Examiner* — Michael Trettel
(74) *Attorney, Agent, or Firm* — Russ Weinzimmer; Russ Weinzimmer & Associates PC

(57) ABSTRACT

An extendable-length, spine immobilizing backboard is disclosed. The backboard is collapsible to the length of a standard backboard for ease of storage and for use in supporting and transporting patients of average height, and a lower portion is telescopically extendable from an upper portion so as to adjustably accommodate patients of above average height. The upper and lower portions are joined by side shafts that telescopically insert into hollow tubes so as to form hand rails on either side of the backboard, and by a flat, rigid central extension that is slidably insertable into a central cavity so as to provide patient support across a gap between the upper and lower portions. The backboard can be collapsed to a length that is six feet, and extended to a length of eighty inches. In some embodiments, the backboard is wider than a standard backboard, being preferably 21 inches wide.

16 Claims, 15 Drawing Sheets

U.S. PATENT DOCUMENTS

| | | | |
|---|---|---|---|
| 7,082,632 | B2 | 8/2006 | Hood |
| 7,165,278 | B2 | 1/2007 | Tomcany et al. |

OTHER PUBLICATIONS http://www.pemed.com/gurneys/gurney.htm List: $1300. MedCon: ex. Ferno Washington patient shifter. used to transfer patients from wherever they may be, such as the ground, onto either a gurney or ambulance or other.
http://www.bpmedicalsupplies.com/products.sc;jsessionid=9E2621B3BD0745250717EDE0BBD4605D.qscstrfrnt03?categoryId=9&productId=1001.

* cited by examiner

ADJUSTABLE-LENGTH SPINE-IMMOBILIZING BACKBOARD

FIELD OF THE INVENTION

The invention generally relates to patient transport devices for use by emergency medical personnel, and more specifically to spine-immobilizing backboards.

BACKGROUND OF THE INVENTION

When emergency medical personnel respond to the scene of an accident, it is often necessary for them to immobilize the spine of a patient so as to avoid any chance of aggravating a possible spinal injury while transporting the patient to a medical facility. This must be done with care, due to the delicate nature of spinal injuries, but it also must be done quickly, since the patient may be in need of urgent medical attention that can only be provided at a hospital or other medical facility.

So as to safely transport a patient with a possible spinal injury, emergency medical vehicles typically carry a spine immobilizing backboard. The backboard must be rigid, and strong enough to carry a full-sized adult male without sagging or breaking. Most backboards used by emergency and rescue professionals are 72" (6') long. These boards are sufficient for the transporting most patients up to 6' tall, but are not suitable for someone that is more than 6' 6" in height, since the feet and calves of the patient will extend beyond the end of the board, possibly resulting in the application of unwarranted stress and possible injury to the lumbar region of the spinal column. Backboards with lengths up to 80" (6' 8") exist, but due to their cumbersome size they are used mostly at specific, fixed locations, such as professional sporting arenas.

When a very tall patient is the object of an emergency response, the patient is typically placed on a spine immobilizing backboard of standard length in preparation for transport to a hospital. Once the patient is on the standard backboard, if it is determined that the standard backboard is too short, a "pediatric spine board" is often placed on top of the standard backboard and positioned underneath the head and torso of the patient. However, this entire procedure typically provides inferior support for the patient, and it can require up to 15 minutes to complete, as compared to an average of 5 minutes or less when immobilizing and transporting someone of average height.

The typical 18 inch width of a standard backboard is sometimes also insufficient for use with large patients, making it difficult to grasp and hold the handles provided along the sides of the backboard.

SUMMARY OF THE INVENTION

An extendable-length, spine immobilizing backboard is claimed. The claimed backboard is collapsible to the length of a standard backboard for ease of storage and for use in supporting and transporting patients of average height. For transporting and supporting patients of above-average height, a lower portion of the backboard is telescopically extendable from an upper portion so as to accommodate the extra height of the patient.

The upper and lower portions are joined by shafts that telescopically insert into hollow tubes so as to form hand rails on either side of the backboard, and by a rigid, flat, central extension that is slidably inserted into a central cavity so as to provide patient support across the gap between the upper and lower portions. In preferred embodiments, the claimed backboard can be collapsed to a length of 72 inches (six feet), and can be extended to a total length of 80" (6' 8"). In some embodiments, the backboard length can be adjusted while a patient is being supported thereupon. In further preferred embodiments, the claimed backboard is wider than a standard backboard, being preferably 21 inches wide.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1A:
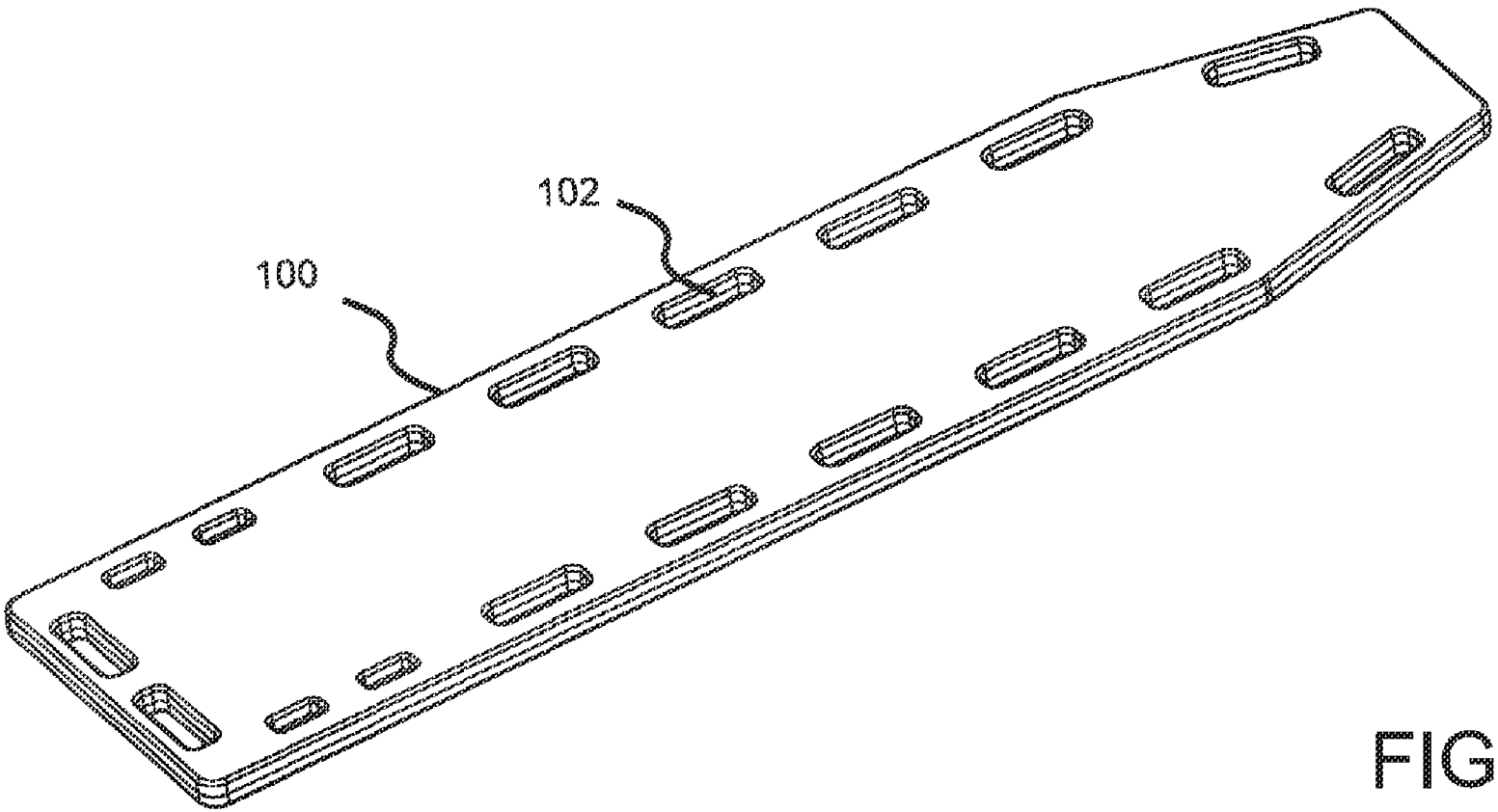
FIG 1A (prior art)
FIG. 1A is a perspective view of a typical spine immobilizing backboard of the prior art.
Figure 1B:
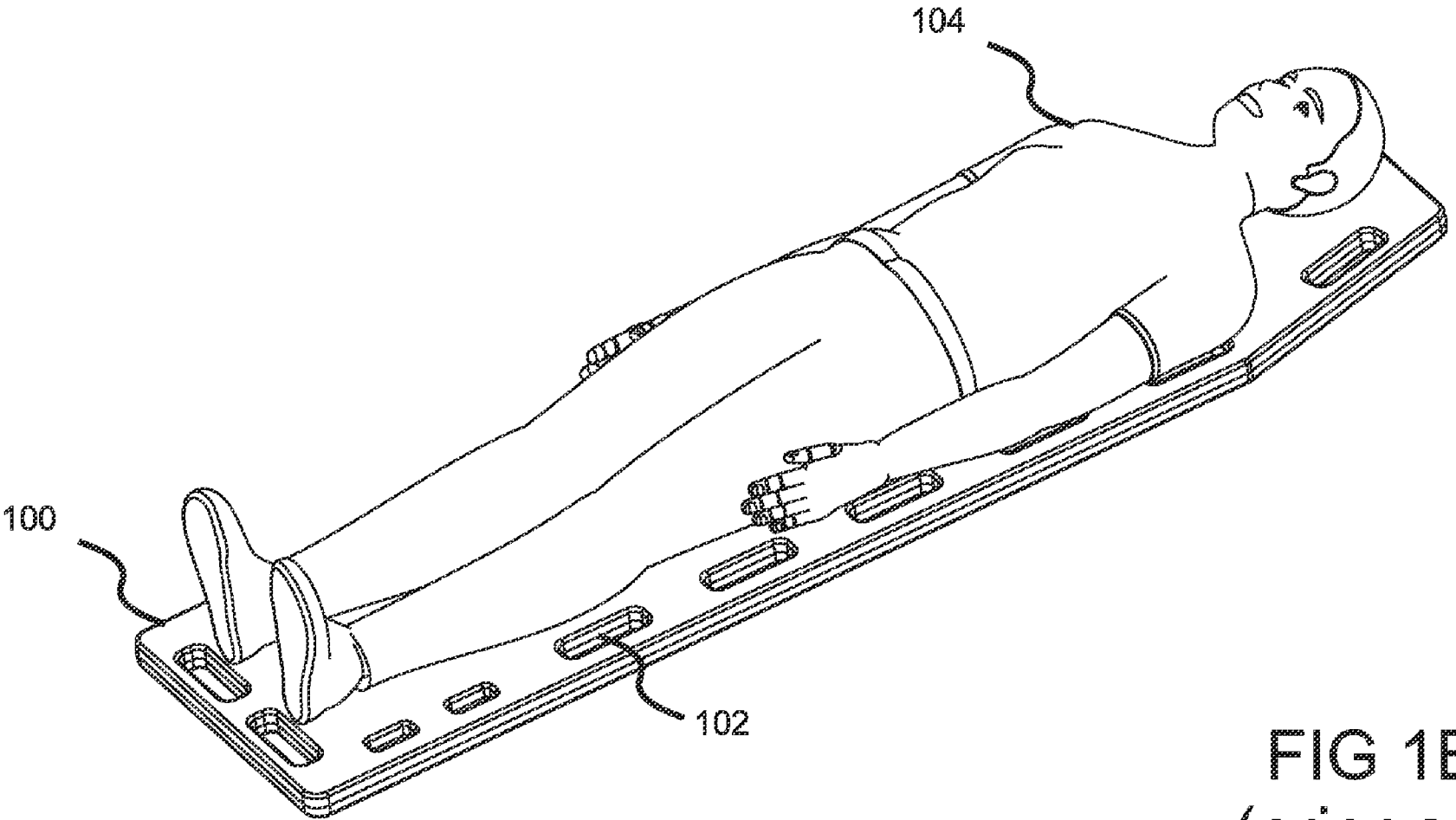
FIG 1B (prior art)
FIG. 1B is a perspective view of the prior art backboard of FIG. 1A supporting a patient of average height and weight.

With reference to FIG. 1A and FIG. 1B, a typical spinal-immobilizing backboard of the prior art includes a rigid board 100 surrounded by handles 102 that is of appropriate size to support and immobilize the backbone of a patient 104 of average height and weight. Typically, such backboards are six feet in length and eighteen inches in width, and can adequately support an adult 104 with a height of less than six feet and six inches. In addition to a full-sized board as shown, so as to accommodate infants, emergency vehicles often carry a small version of the illustrated backboard 100.

Figure 1C:
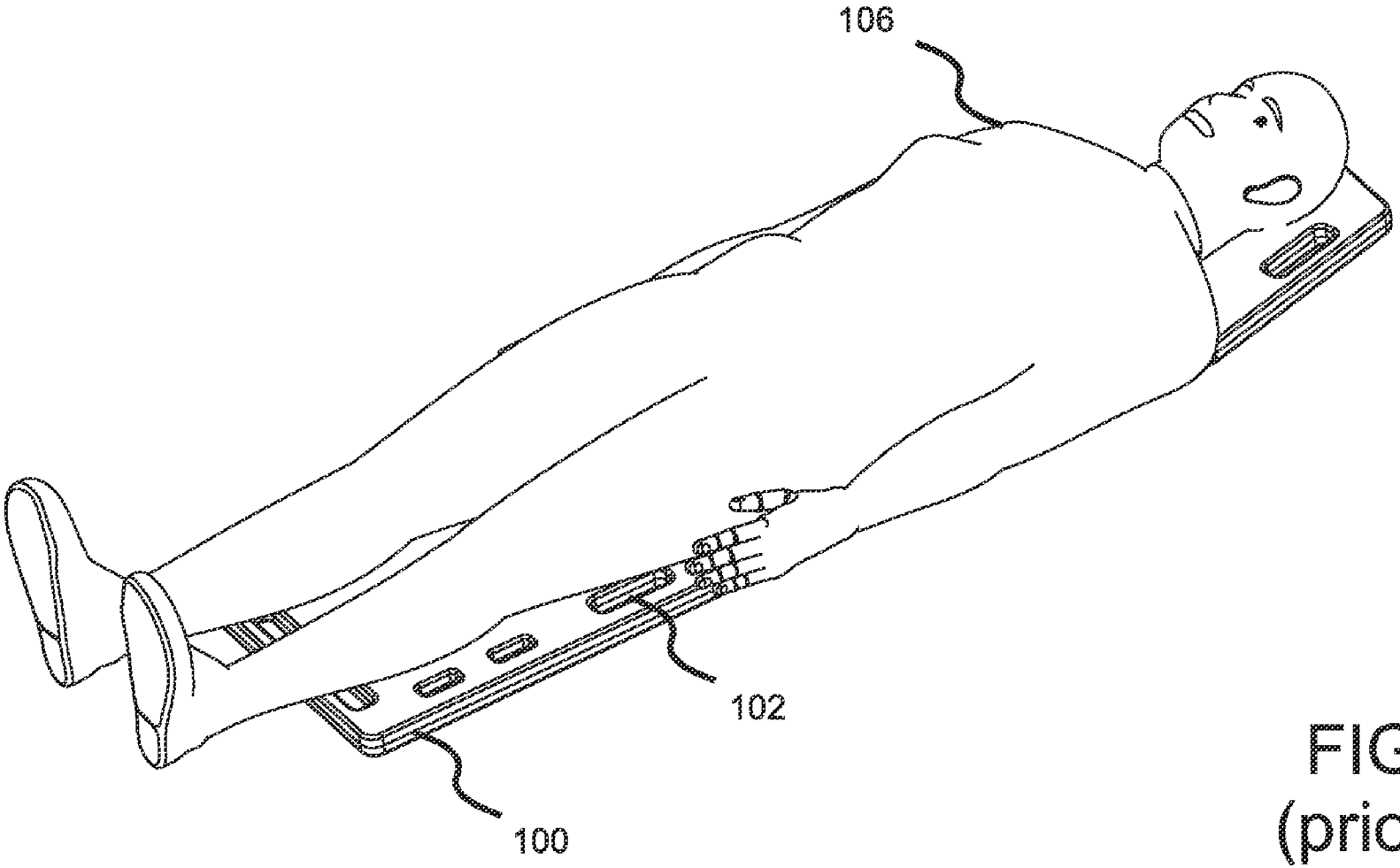
FIG 1C (prior art)
FIG. 1C is a perspective view of the prior art backboard of FIG. 1B supporting a patient of above-average height and weight.
Figure 1D:
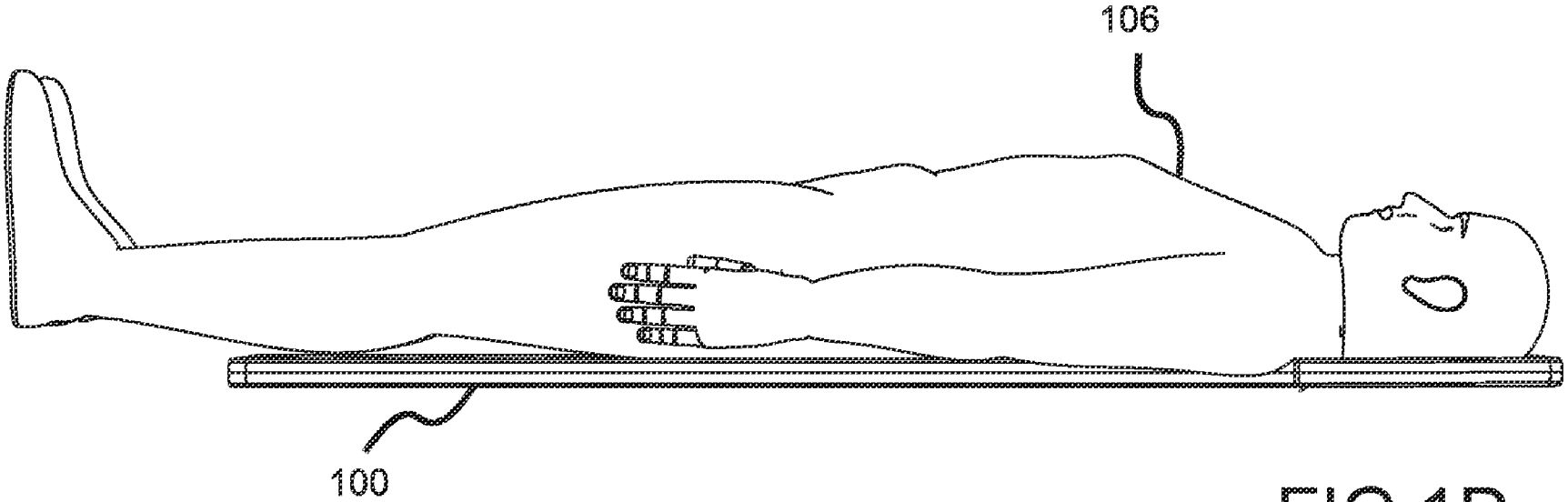
FIG 1D (prior art)
FIG. 1D is a side view of the backboard and patient of FIG. 1C.

With reference to FIG. 1C and FIG. 1D, when an attempt is made to use a typical backboard of the prior art 100 to support a patient 106 with a height and/or weight that is well above average, the feet and calves of the patient 106 can extend beyond the end of the board 100, possibly resulting in the application of unwarranted stress to the lumbar region of the patient's spinal column. For a patient 106 of above average weight, the patient may also be too wide for the backboard 100, making it difficult to grasp the handles 102. Sometimes, after a patient 106 has been placed on an insufficiently long backboard 100, an attempt is made to attach an infant backboard to the standard backboard 100, so as to extend its length. This additional handling of the patient 106 can cause precious time to be wasted, and can still result in poor support for the patient.

Figure 2A:
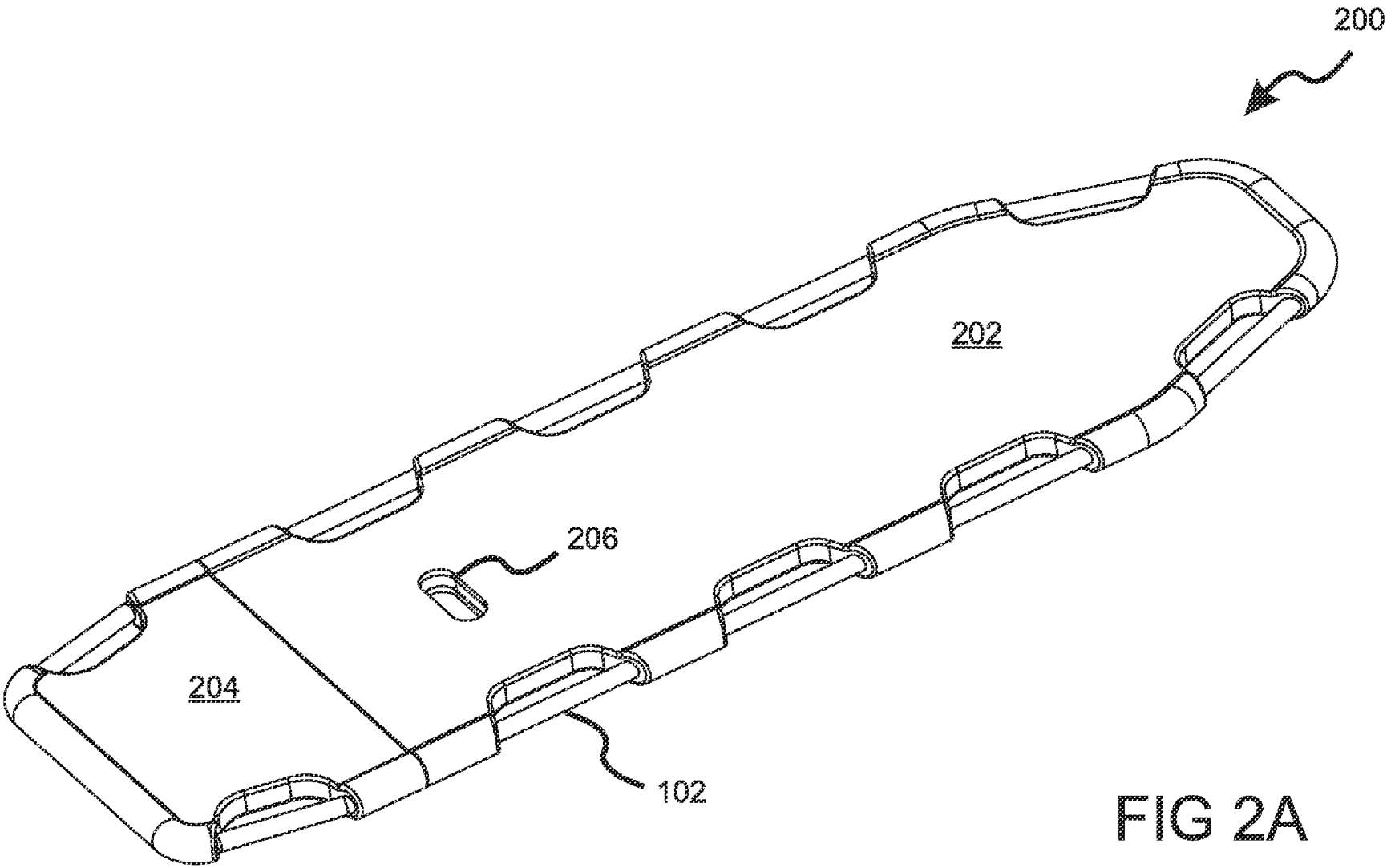
FIG. 2A is a perspective drawing of an embodiment of the present invention shown in a non-extended configuration.

A preferred embodiment of the present invention is illustrated in FIG. 2A. The extendable backboard 200 of the present invention includes an upper portion 202 and a lower portion 204 that are extendably joined together near the "foot" end of the backboard 200. A hole 206 is provided in the upper part through which a latching plug (308 in FIG. 3B, discussed in more detail below) can be inserted so as to fix the position of the lower part 204 in relation to the upper part 202. See the discussion with reference to FIG. 3A through FIG. 3C below for details regarding this latching mechanism.

Figure 2B:
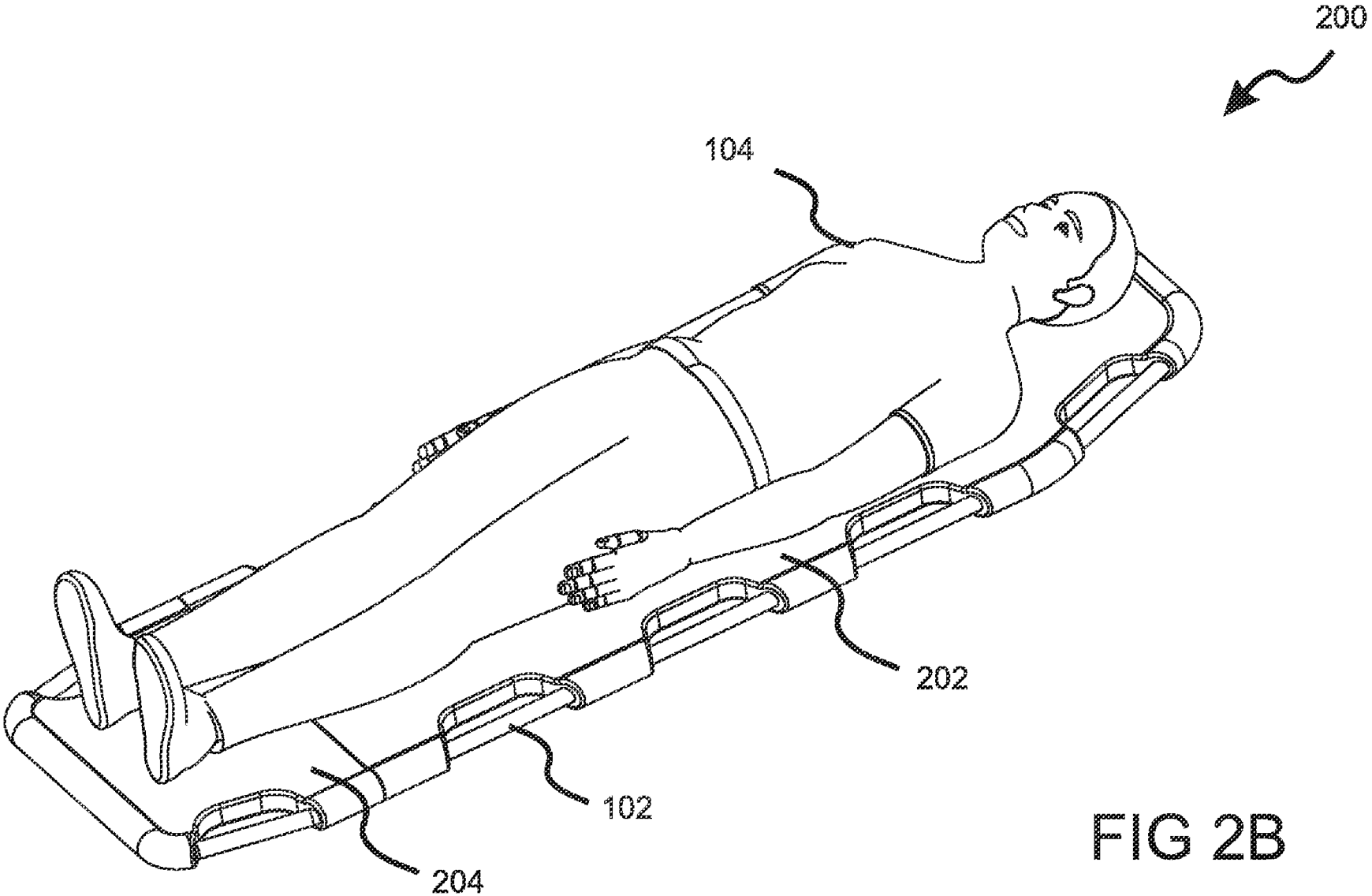
FIG. 2B is a perspective view of the embodiment of FIG. 2A supporting a patient of average height and weight.
Figure 2C:
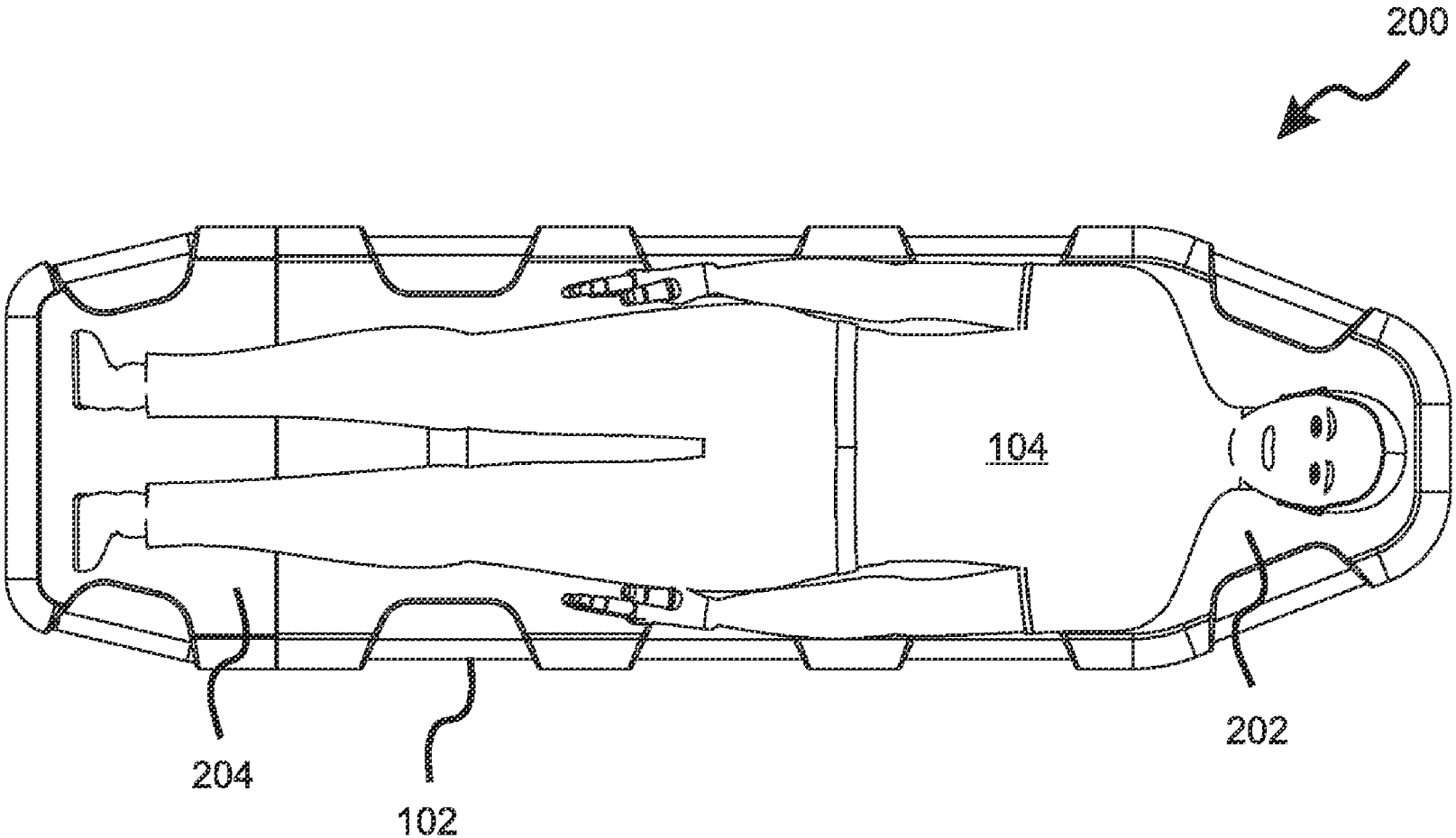
FIG. 2C is a top view of the embodiment of FIG. 2B.

In preferred embodiments, the construction of the backboard 200 includes a linear low-density polyethylene outer shell and a pultruded carbon fiber core material. In its unextended configuration, as shown in FIG. 2A, the backboard is of comparable length to a standard backboard 100 of the prior art. In the embodiment of FIG. 2A, the backboard is preferably three inches wider than a standard backboard 100. As can be seen in FIG. 2B and FIG. 2C, the illustrated embodiment 200 provides ideal spine-immobilizing support for a patient 104 of average height and weight.

Figure 3A:
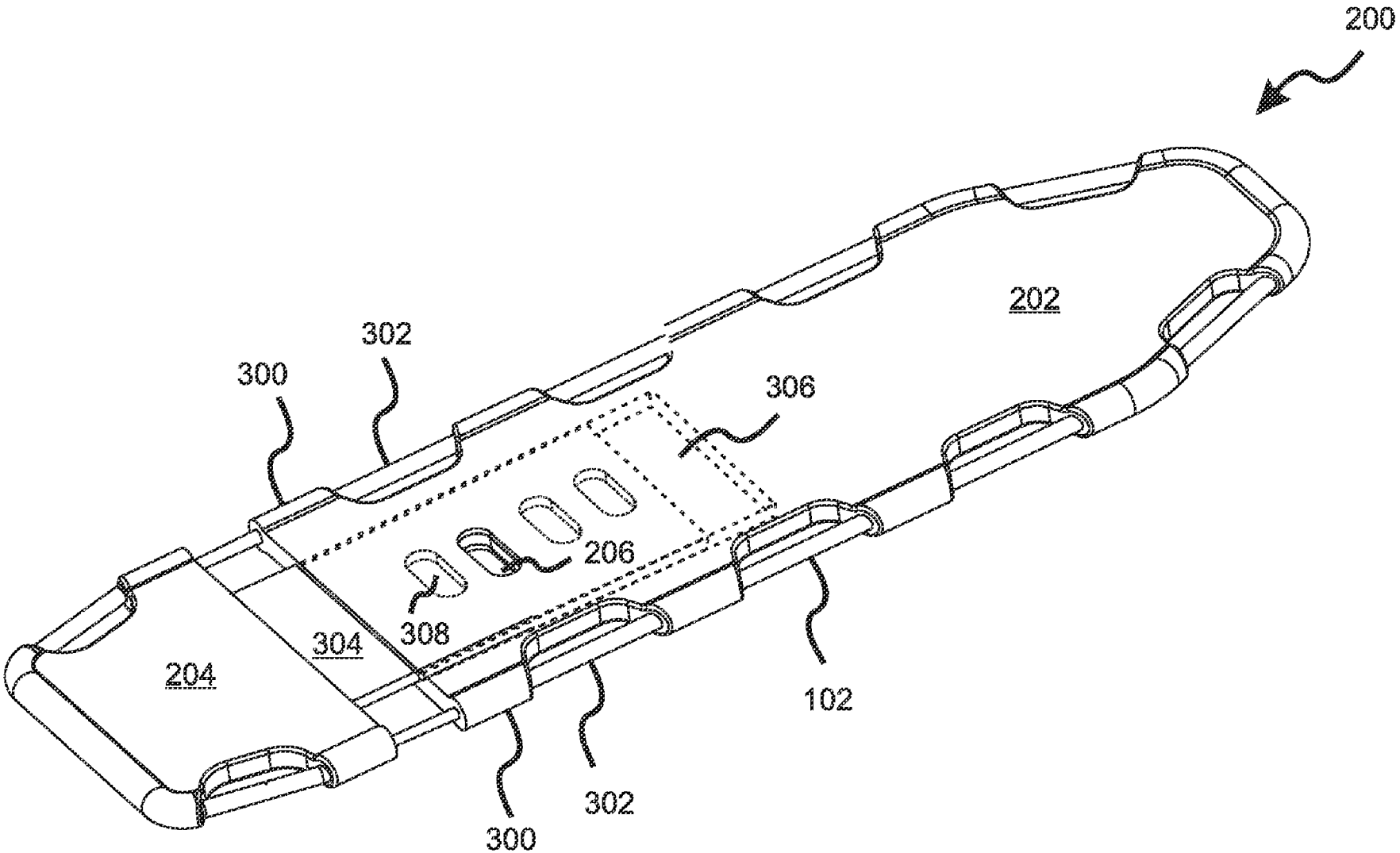
FIG. 3A is a perspective view of the embodiment of FIG. 2A shown in a partially extended configuration.

FIG. 3A illustrates the embodiment of FIG. 2A in a partially extended configuration. Shafts 300 extending from each side of the lower portion 204 are telescopically inserted into hollow tubes 302 located on each side of the upper section. The shafts 300 and tubes 302 thereby form extensions of the rails that form the handles 102 surrounding the backboard 200. A flat, central extension 304 attached to the lower portion 204 is inserted into a central cavity 306 in the upper portion 202, thereby forming an extendable support structure that bridges the gap formed between the upper 202 and lower 204 portions of the backboard as it is extended. In the embodiment of FIG. 3A, holes 306 are provided in the extension 304 that can be aligned with the hole 206 in the upper section 202 so as to allow for insertion of a latching plug (308 in FIG. 3B) to fix the position of the lower portion 204 relative to the upper portion 202.

Figure 3B:
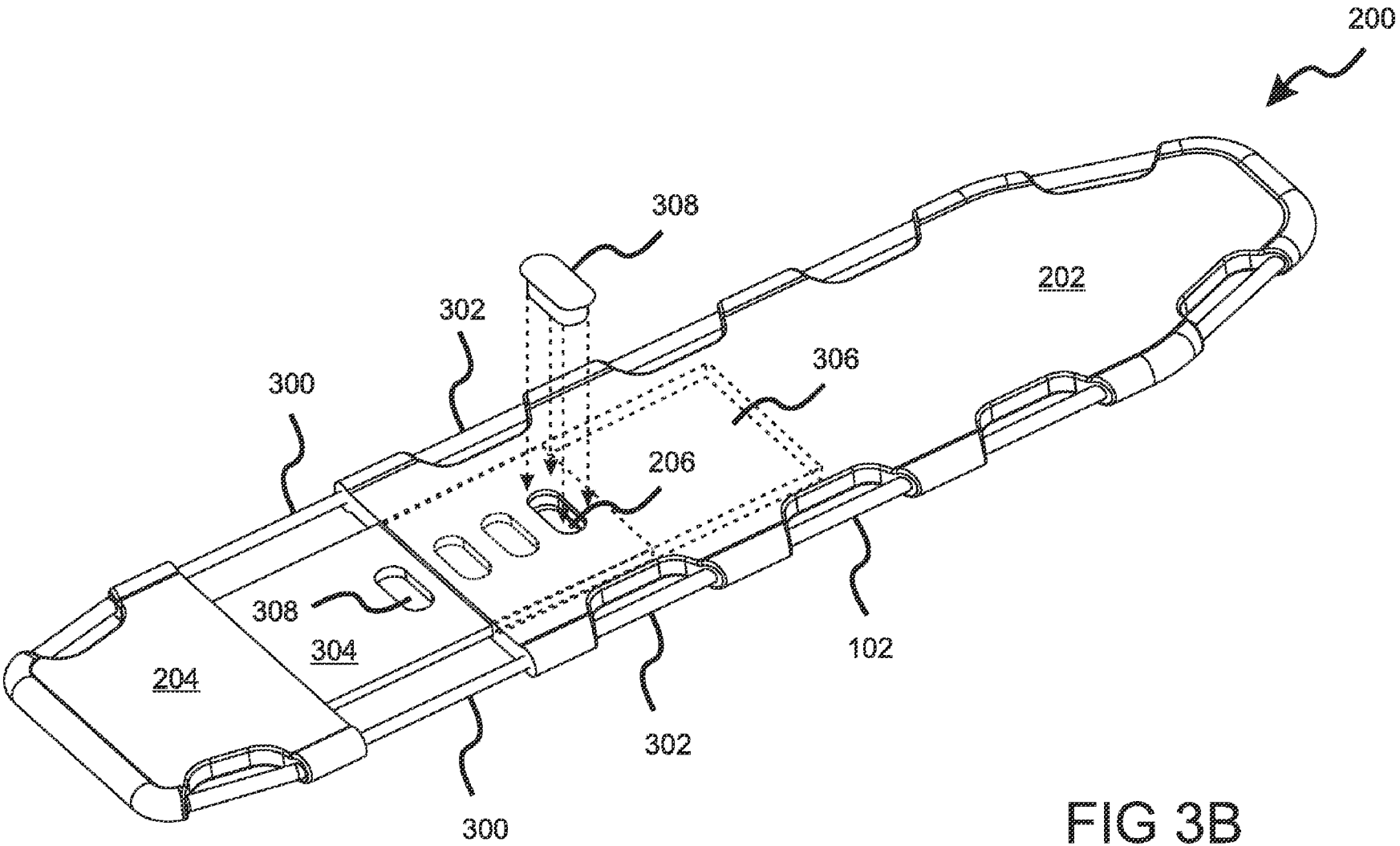
FIG. 3B is a perspective view of the embodiment of FIG. 2A shown in a fully extended configuration and showing a latching plug in position for insertion into the backboard.
Figure 3C:
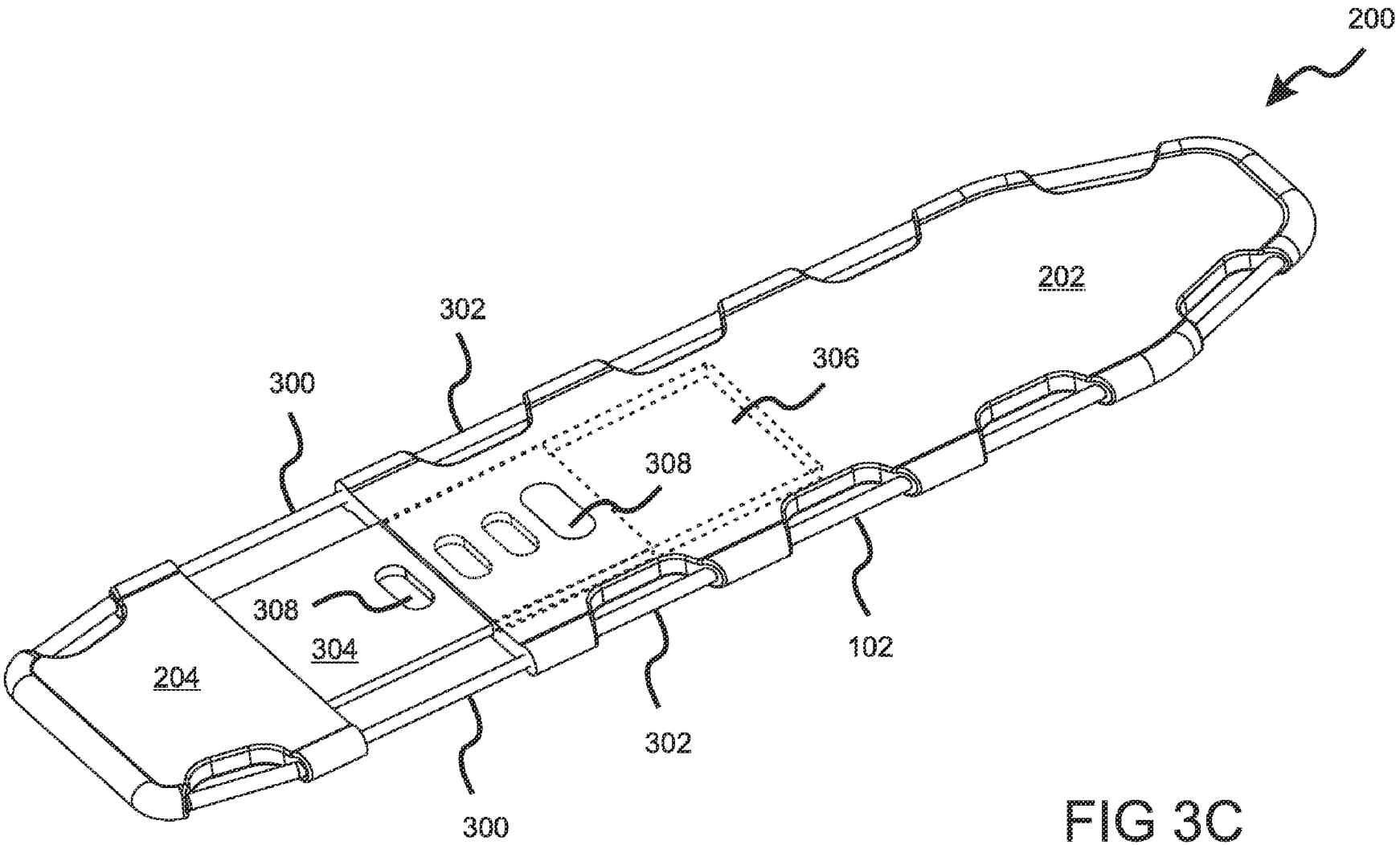
FIG. 3C is a perspective view of the embodiment of FIG. 3B, shown with the latching plug installed.

The embodiment of FIG. 3A is shown in FIG. 3B in its fully extended configuration, which in preferred embodiments provides a backboard with a length of six feet and eight inches. A latching plug 308 is shown positioned above the upper portion 202 in alignment for insertion through the holes 206, 306 in the upper 202 and lower 204 portions of the backboard 200, so as to fix the position of the lower portion 204 relative to the upper portion 202. FIG. 3C illustrates the embodiment of FIG. 3B with the latching plug 308 installed.

Figure 4A:
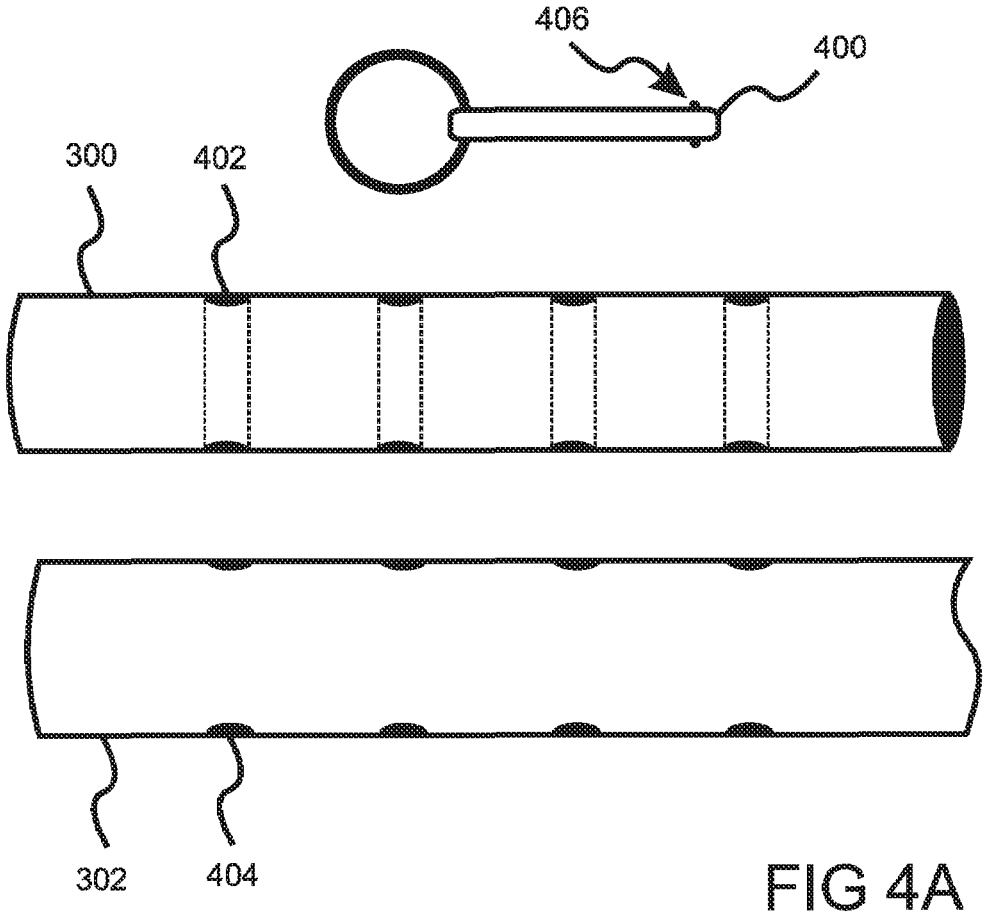
FIG. 4A is an illustration of a latching mechanism that uses a key pin inserted through holes in the telescoping side rails to fix the length of the backboard, the latching mechanism being shown in a disassembled state.
Figure 4B:
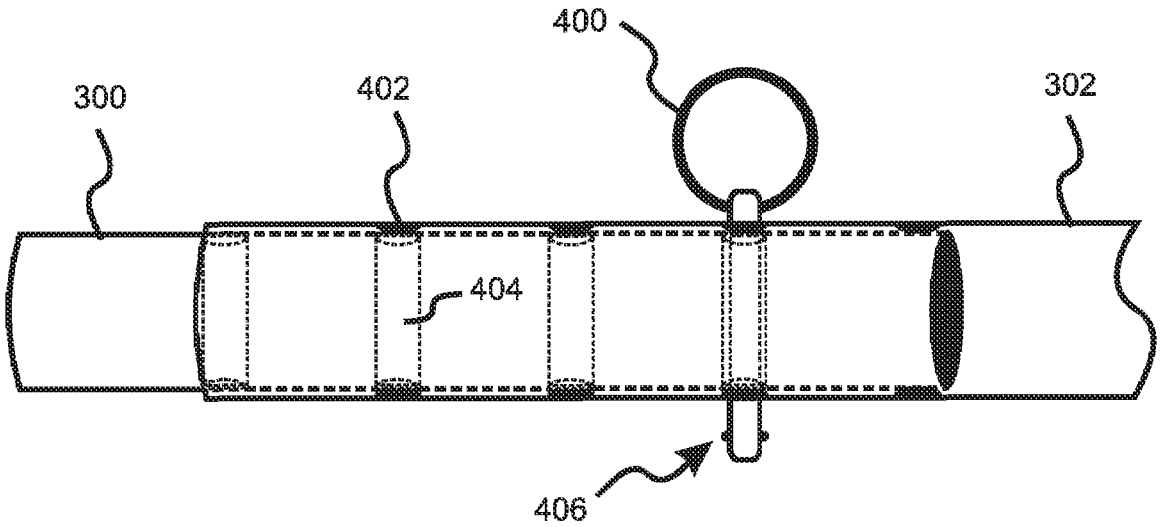
FIG. 4B is an illustration of the latching mechanism of FIG. 4A, shown in an assembled state.

FIG. 4A is a disassembled view of a latching mechanism in a preferred embodiment in which a key 400 is inserted through holes 402 provided in the shafts 300, and through corresponding holes 404 provided in the hollow tubes 302. FIG. 4B illustrates the latching mechanism of FIG. 4A in its assembled and latched configuration. Small, spring-loaded protrusions 406 near the end of the key 400 keep the key from failing out of the holes 402, 404 while the backboard is in use. The latching mechanism of FIG. 4A and FIG. 4B is accessible even when a patient is already being supported by the backboard 200, thereby allowing the length of the backboard 200 to be adjusted after placement of a patient thereupon.

Figure 5A:
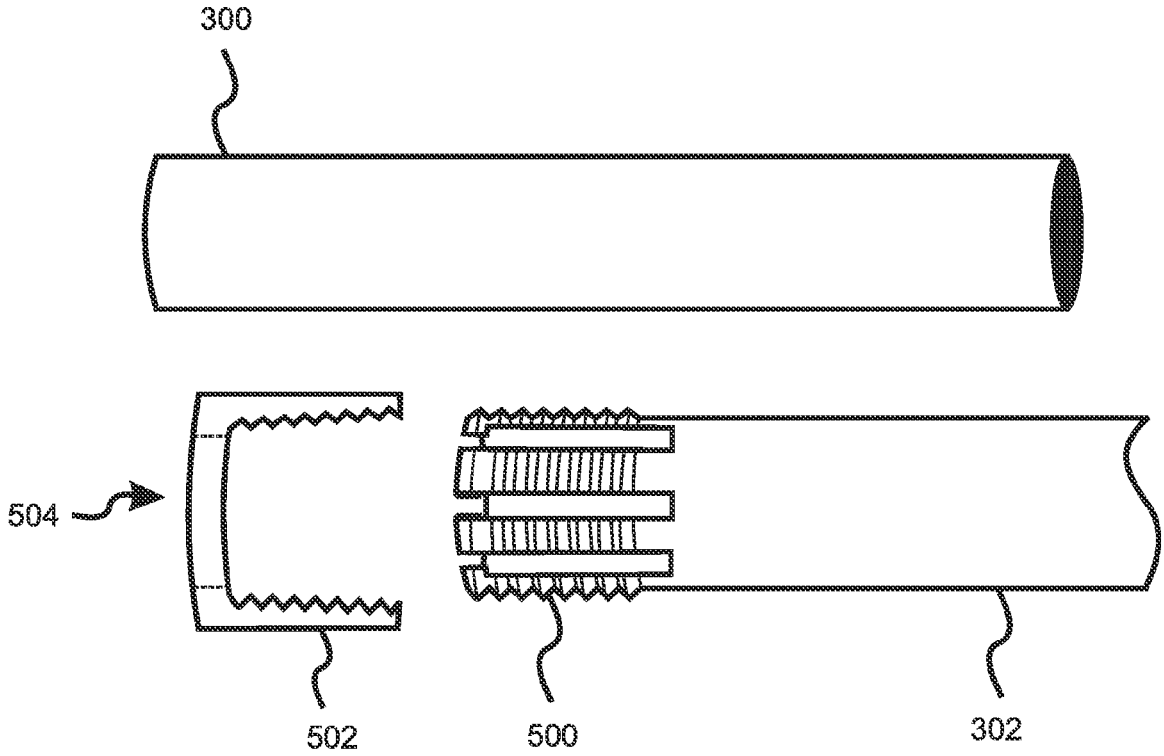
FIG. 5A is an illustration of a latching mechanism that uses a tapered cap threaded onto a slotted tube to clamp a telescopically inserted shaft in place and thereby fix the length of the backboard, the latching mechanism being shown in a disassembled state.
Figure 5B:
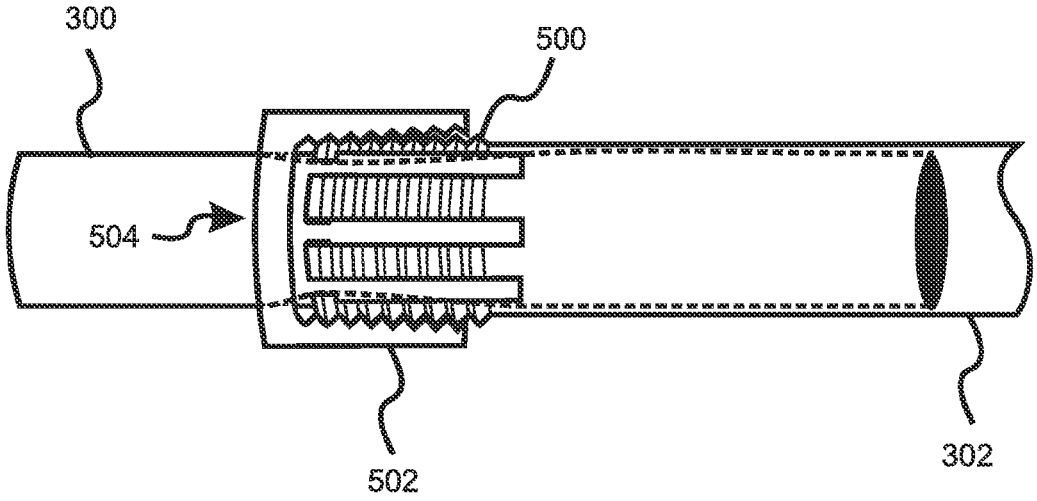
FIG. 5B is an illustration of the latching mechanism of FIG. 5A, shown in an assembled state.

FIG. 5A illustrates a latching mechanism of another embodiment of the present invention that allows adjustment of the length of the backboard 200 after a patient has already been placed thereupon. In this embodiment, each of the hollow tubes 304 provided in the upper portion 202 of the backboard 200 terminates in a series of threaded fingers 500. Caps 502 with tapered threads cut into their interiors can be screwed onto the threaded fingers 500, thereby forcing the fingers 500 toward each other as the caps 502 are tightened. FIG. 5B illustrates the latching mechanism of FIG. 5A in its assembled and latched configuration. The shafts 300 extending from the lower portion 204 of the backboard 200 have been inserted through holes 504 provided in the caps 502, through the fingers 500, and into the hollow tubes 302. The caps 502 have then been tightened onto the fingers 500, thereby gripping the shafts 300. For ease of illustration, the cap in FIGS. 5A and 5B has been shown in cross section, while the shaft 300 and hollow tube 302 have been shown in perspective views.

Figure 6A:
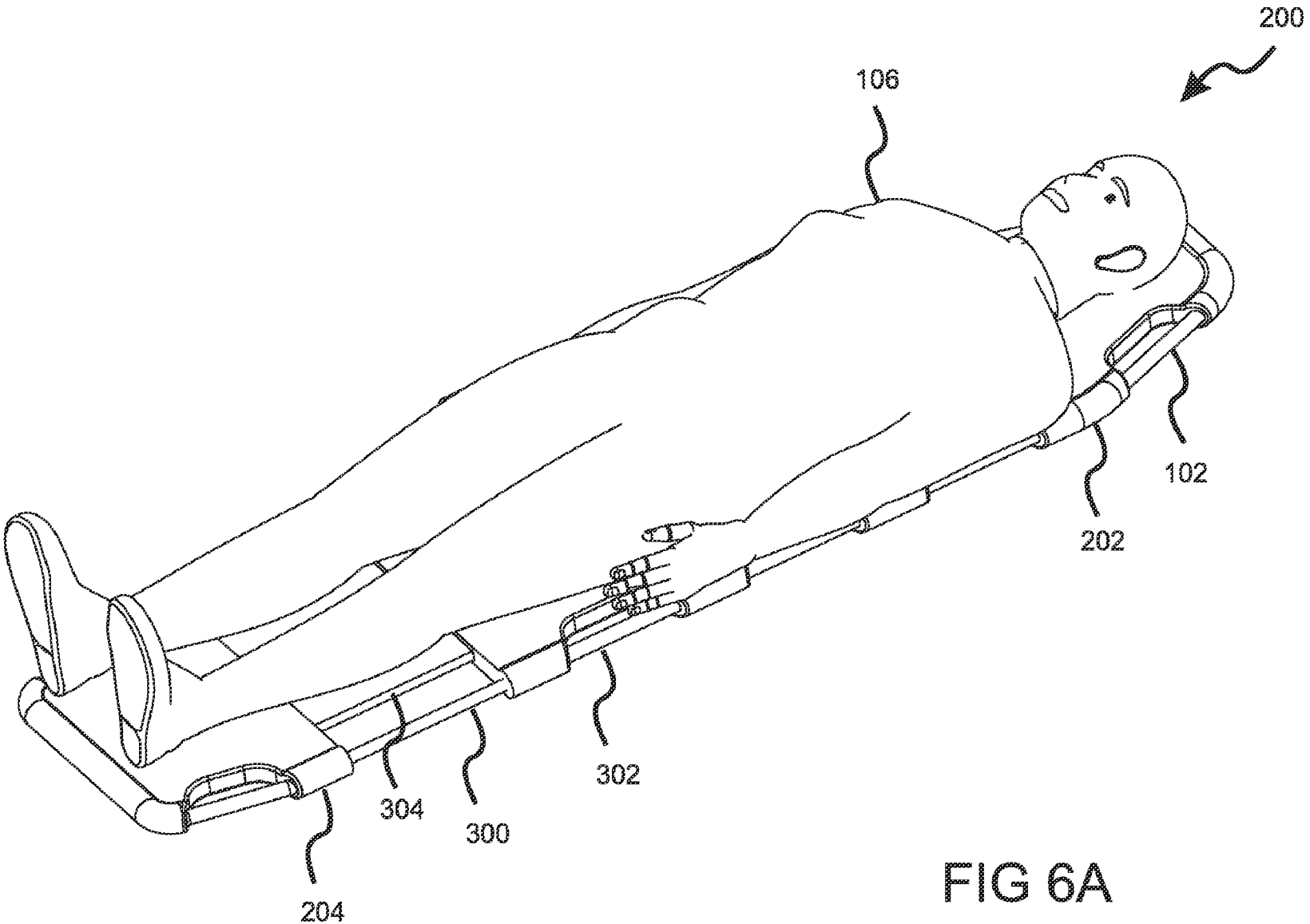
FIG. 6A is a perspective view of the embodiment of FIG. 3A shown in a fully extended configuration and supporting a patient of above-average height and weight.
Figure 6B:
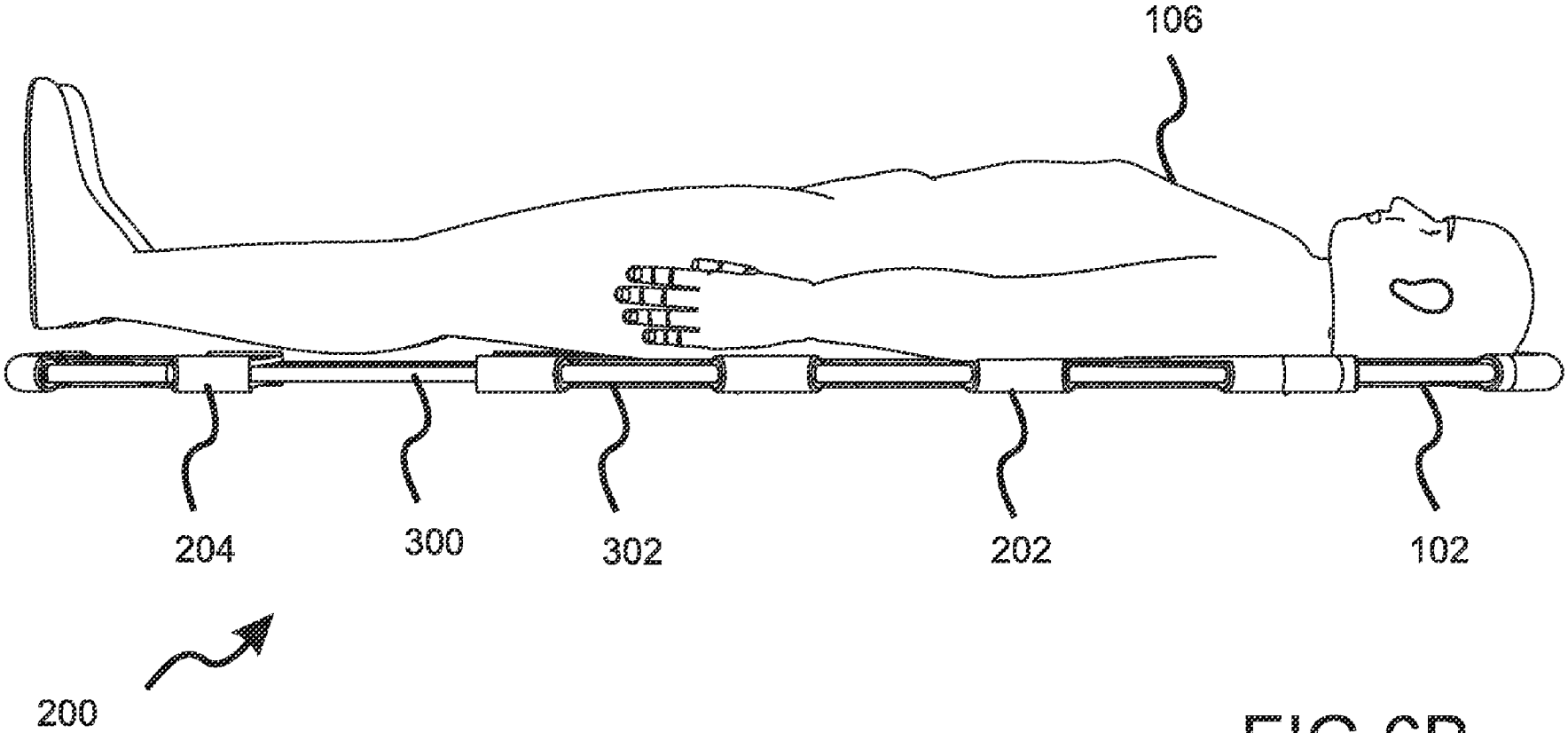
FIG. 6B is a side view of the embodiment of FIG. 6A.
Figure 6C:
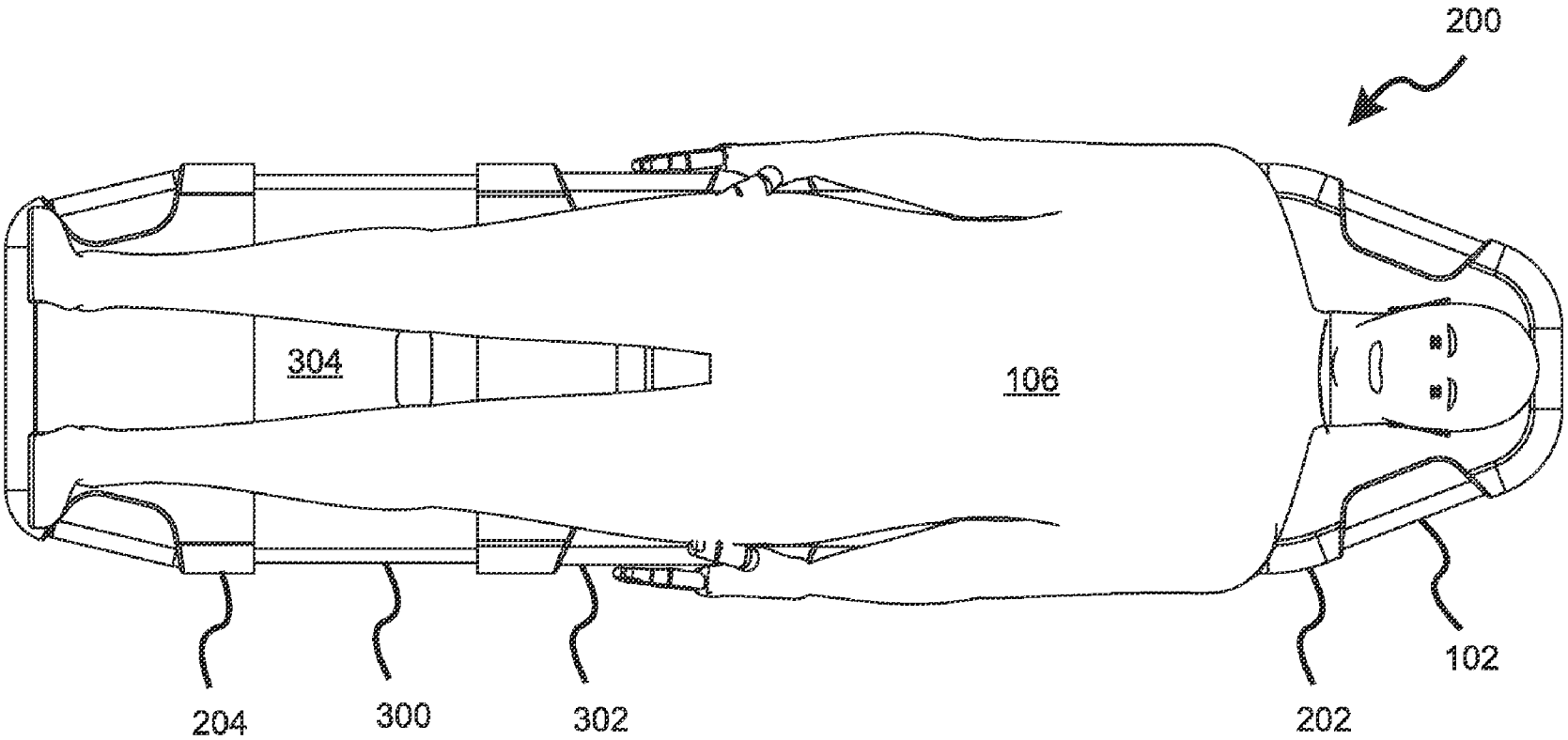
FIG. 6C is a top view of the embodiment of FIG. 6A.

FIG. 6A is a perspective view of the embodiment of FIG. 3B supporting a larger than average patient 106. In preferred embodiments, the length of the backboard 200 can be adjusted after the patient 106 has been placed on the backboard 200. FIG. 6B and FIG. 6C illustrate the embodiment of FIG. 6A from the side, and from above, respectively. In the embodiment of FIG. 6B, the diameter of the handles 102 is small enough to allow them to be grasped when the backboard 200 is resting on the ground.

Other modifications and implementations will occur to those skilled in the art without departing from the spirit and the scope of the invention as claimed. Accordingly, the above description is not intended to limit the invention except as indicated in the following claims.

What is claimed is:

1. An extendable, spine-immobilizing backboard for securing and transporting patients of regular and above-average height, the extendable backboard comprising:

a lower backboard portion and an upper backboard portion, the backboard portions being joinable to each other by insertion of a rigid, flat, central extension from one of the backboard portions into a corresponding central cavity located in the other backboard portion, thereby forming a backboard that is extendable in length and able to provide horizontal, spine-immobilizing support to a patient;

a pair of shafts, each shaft extending from a side of one of the backboard portions and insertable into a corresponding hollow tube in a side of the other backboard portion, the shafts and hollow tubes thereby cooperating so as to form extendable rails attached to two opposing sides of the backboard; and a latching mechanism, cooperative with at least one of:

one of the extendable rails; and the central extension, the latching mechanism being configured so as to enable fixing of the length of the backboard.

2. The extendable backboard of claim 1, wherein the central extension extends from the lower backboard portion and the central cavity is located in the upper backboard portion.

3. The extendable backboard of claim 1, wherein the shafts extend from the lower backboard portion, and the hollow tubes are attached to the upper backboard portion.

4. The extendable backboard of claim 1, wherein the extendable rails form grasping handles along the two opposing sides of the joined backboard portions.

5. The extendable backboard of claim 4, wherein the grasping handles are of sufficiently small diameter to provide grasping clearance beneath the grasping handles when the extendable backboard is resting on a flat surface.

6. The extendable backboard of claim 1, wherein the extendable backboard has a width of at least twenty-one inches.

7. The extendable backboard of claim 1, wherein the extendable backboard is extendable to a length of at least eighty inches.

8. The extendable backboard of claim 1, wherein the extendable backboard is constructed at least partly from X-ray transparent materials.

9. The extendable backboard of claim 1, wherein the upper portion is of sufficient dimensions to support at least the head, torso, and hips of a patient having a height of at least six feet, eight inches.

10. The extendable backboard of claim 1, wherein the structure of the extendible backboard includes at least one of:

a linear low density polyethylene outer shell;

a carbon fiber composite material; and a pultruded carbon fiber material.

11. The extendable backboard of claim 1, wherein the latching mechanism includes:

a series of shaft holes provided in one of the pair of shafts;

a single tube hole provided in the hollow tube that corresponds to the shaft, the tube hole being alignable with any of the shaft holes when the shaft is inserted into the hollow tube; and a pin that can be inserted through the tube hole and into one of the shaft holes, so as to fix the relative positioning of the shaft and the hollow tube.

12. The extendable backboard of claim 1, wherein the latching mechanism includes:

a plurality of longitudinal slots cut into a male-threaded end of one of the hollow tubes, thereby forming a plurality of fingers in the male-threaded end of the hollow tube; and a female-threaded cap that can be tightened onto to the male-threaded end of the hollow tube, the female-threaded cap including a hole through which a shaft can pass for insertion into the hollow tube, the female-threaded cap including a tapered interior that tends to compress the fingers of the hollow tube together when the female-threaded cap is tightened onto the male-threaded hollow tube, there by clamping the inserted shaft in place.

13. The extendable backboard of claim 1, wherein the latching mechanism includes:

a female-threaded cap that can be tightened onto a male-threaded end of one of the hollow tubes, the female-threaded cap having a hole through which a shaft can pass for insertion into the hollow tube; and an O-ring locatable between the threaded cap and the threaded end of the hollow tube so as to tighten onto the inserted shaft and fix the inserted shaft in place when the female-threaded cap is tightened onto the male threaded end of the hollow tube.

14. The extendable backboard of claim 1, wherein the latching mechanism includes:

a series of extension holes provided in the central extension;

a single cavity hole provided in at least one bounding surface of the central cavity, the cavity hole being alignable with any of the extension holes when the central extension is inserted into the central cavity; and a latching plug that can be inserted through the cavity hole and into one of the extension holes, so as to fix the relative positions of the central cavity and the central extension.

15. The extendable backboard of claim 1, wherein the extendable backboard is configured so as to allow the backboard to be adjusted in length while a patient is being supported thereby.

16. The extendable backboard of claim 1, wherein the backboard is capable of securing and transporting patients ranging in at least one of height and weight from a fifth percentile female up to a 99'th percentile male.

* * * * *